US005085030A

United States Patent [19]

Segawa et al.

[11] Patent Number: 5,085,030

[45] Date of Patent: Feb. 4, 1992

[54] METHOD OF TRANSFERRING AND STORING GLASS SHEETS AND TRAY USED IN METHOD

[75] Inventors: Toyoo Segawa; Sinkichi Syono; Syuichi Suzue, all of Osaka, Japan

[73] Assignee: Nippon Sheet Glass, Co., Ltd., Osaka, Japan

[21] Appl. No.: 405,081

[22] Filed: Sep. 6, 1989

Related U.S. Application Data

[63] Continuation of Ser. No. 205,557, Jun. 7, 1988, abandoned, which is a continuation of Ser. No. 10,986, Feb. 5, 1987, abandoned.

[30] Foreign Application Priority Data

Feb. 5, 1986 [JP] Japan ..... 61-23508

[51] Int. Cl.[5] ..... B65B 23/20; B65B 35/50

[52] U.S. Cl. ..... 53/399; 53/441; 53/447

[58] Field of Search ..... 53/399, 441, 447, 465; 206/451, 454; 108/55.1, 55.3, 901

[56] References Cited

U.S. PATENT DOCUMENTS

| | | | |
|---|---|---|---|
| 2,481,233 | 9/1949 | Morse | 108/55.3 |
| 3,618,755 | 11/1971 | Kean | 206/454 |
| 3,805,473 | 4/1974 | Lidgard | 206/451 |
| 3,880,286 | 4/1975 | Wegener | 206/451 |
| 3,939,978 | 2/1976 | Thomaswick | 206/454 |
| 4,051,787 | 10/1977 | Nishitani | 108/55.3 |
| 4,216,640 | 8/1980 | Kaufman | 53/587 |
| 4,232,501 | 11/1980 | Stachduse | 53/399 |
| 4,287,990 | 9/1981 | Kurick | 206/454 X |
| 4,397,246 | 8/1983 | Ishida | 108/55.3 |
| 4,458,467 | 7/1989 | Shulman | 53/587 |

*Primary Examiner*—John Sipos
*Attorney, Agent, or Firm*—Pretty Schroeder Brueggemann & Clark

[57] ABSTRACT

A number of glass sheets of given size are stacked flatwise on a tray having on its upper surface dampers for preventing the glass sheets from slipping. The stacked glass sheets are fixed relatively to each other, and the fixed glass sheets are transferred with the tray to a storage location. The transferred glass sheets and the tray are stored in the storage location.

2 Claims, 6 Drawing Sheets

METHOD OF TRANSFERRING AND STORING GLASS SHEETS AND TRAY USED IN METHOD

This is a continuation of application Ser. No. 205,557, filed June 7, 1988 abandoned; which is a continuation of application Ser. No. 010,986, filed Feb. 5, 1987 abandoned.

BACKGROUND OF THE INVENTION

1 Field of the Invention

The present invention relates to a method of transferring and storing glass sheets, especially flat glass sheets, without scratching or damaging them, and a tray used in the method.

2. Description of the Relevant Art

Flat glass sheets are generally liable to slip on their surfaces irrespective of whether they have frosted patterns or impressed patterns on their surfaces. Therefore, when flat glass sheets are stacked or placed flatwise on a tray having a hard surface, they tend to slip on each other or the tray at the time a conveyor carrying them is started or stopped, with the result that the glass sheet surfaces may have abrasive scratches. One customary solution employed in a continuous glass sheet production facility has been to place and fix glass sheets vertically in a box-shaped pallet of iron or wood that can be disassembled, and to transfer and store the glass sheets in the pallet. This practice is however costly since the pallets used are specially designed and hence very expensive, and makes it difficult to automatize the transfer of glass sheets because manual labor is required to assemble and disassemble the pallets and the pallets must be hoisted and moved by a forklift or the like controlled by a human operator. Glass sheets are produced in different sizes to meet various desired applications. A large number of pallets must be made available in more than ten types in order to meet the dimensions of differently sized glass sheets, and provision of such pallets is costly and causes a storage problem. Since the pallets must be strong enough to withstand the large weight of glass sheets to be carried thereby, the volume and weight of an individual pallet are considerably large, making it relatively inefficient to transfer and store glass sheets.

SUMMARY OF THE INVENTION

According to the present invention, there is provided a method of transferring a number of glass sheets of given size, comprising stacking the glass sheets flatwise on a tray having on its upper surface means for preventing the glass sheets from slipping, fixing the stacked glass sheets relatively to each other, and transferring the fixed glass sheets with the tray.

According to the present invention, there is also provided a method of transferring and storing a number of glass sheets of given size, comprising stacking the glass sheets flatwise on a tray having on its upper surface means for preventing the glass sheets from slipping, fixing the stacked glass sheets relatively to each other, transferring the fixed glass sheets with the tray to a storage location, and storing the transferred glass sheets with the tray in the storage location.

According to the present invention, there is also provided a method of transferring and storing a number of glass sheets of given size, comprising stacking the glass sheets flatwise on a tray having on its upper surface means for preventing the glass sheets from slipping, fixing the stacked glass sheets relatively to each other, transferring the fixed glass sheets with the tray to a storage zone, moving the transferred glass sheets with the tray to a storage location in the storage zone, and storing the moved glass sheets with the tray in the storage location.

It is a primary object of the present invention to provide a method of transferring and storing glass sheets inexpensively without using expensive pallets, while ensuring the desired quality of the glass sheets during transfer and storage.

Another object of the present invention is to provide a method of transferring and storing glass sheets which lends itself to automatization.

Still another object of the present invention is to provide a method of transferring and storing glass sheets with increased efficiency, particularly with far more efficiency for glass sheet storage in a warehouse.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Prior to detailed description of a method according to the present invention, a conventional method shown in FIG. 15 will first be described for a fuller understanding of various advantages of the present invention.

Figure 15:
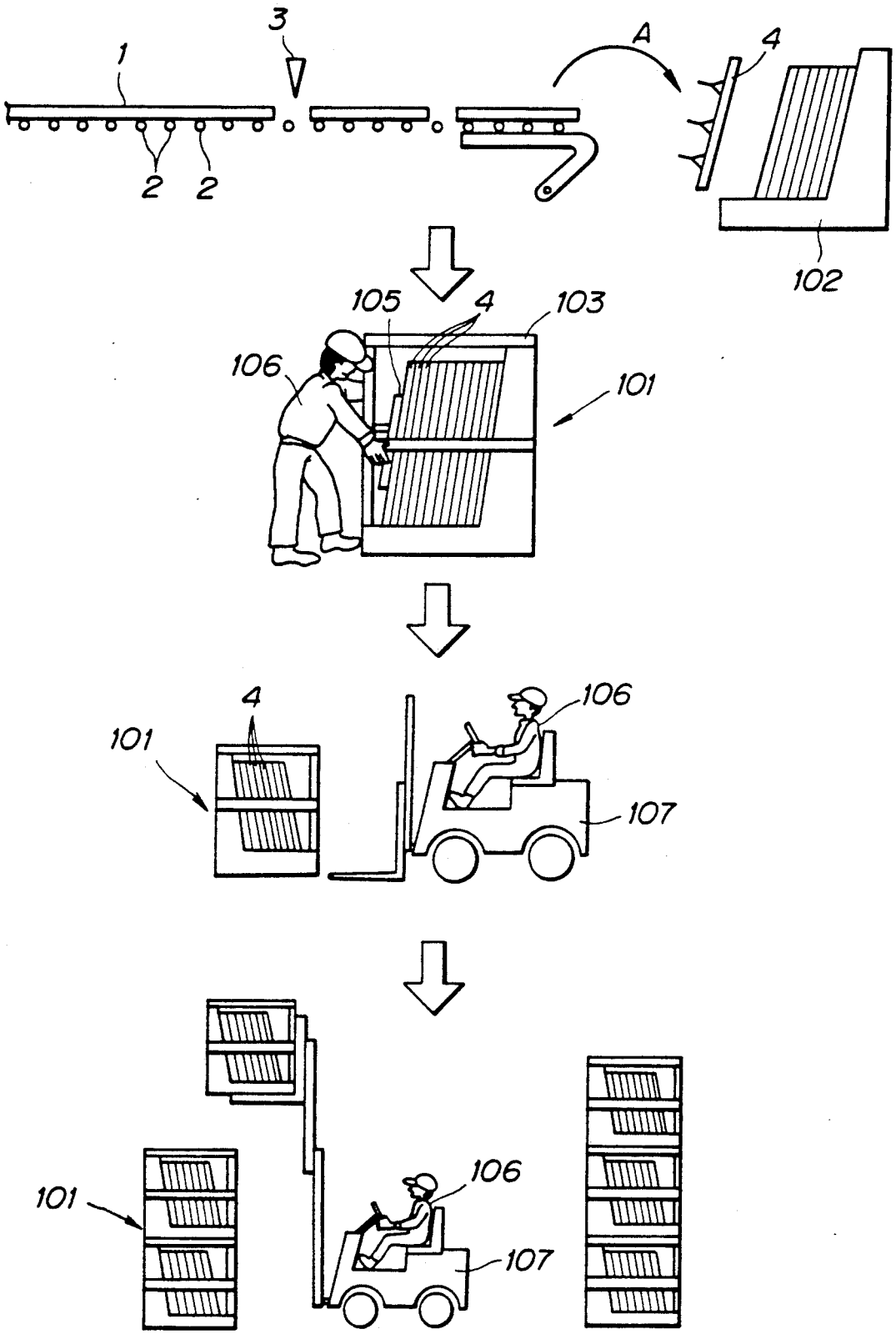
FIG. 15 (PRIOR ART)
FIG. 15 is a schematic view showing a conventional method of transferring and storing glass sheets.

As shown in FIG. 15, an elongate glass ribbon 1 manufactured by a nonillustrated apparatus is cut off on a conveyor 2 by a cutter 3 into a succession of glass sheets 4 of prescribed dimensions. At the terminal end of the conveyor 2, the glass sheets 4 are reversed manually or by a suitable device as indicated by the arrow A, and placed on their edges at an angle ranging from 80° to 90° on the base 102 of a pallet 101. The pallet 101 is in the form of a box of iron or wood that can easily be assembled and disassembled, and includes the base 102 of an L shape and a holder frame 103. After a prescribed number of glass sheets 4 have been placed on the base 102, a holder plate 105 is held against the outermost glass sheet by an operator 106 to secure the glass sheets 4, followed by assembling the holder frame 103 on the base 102. The glass sheets 4 stored in the pallet 101 are hoisted and transferred by a forklift 107 controlled by the operator 106 to a storage location such as a warehouse. In the warehouse, two through four pallets 101 with stored sheets 4 are stacked.

Figure 1:
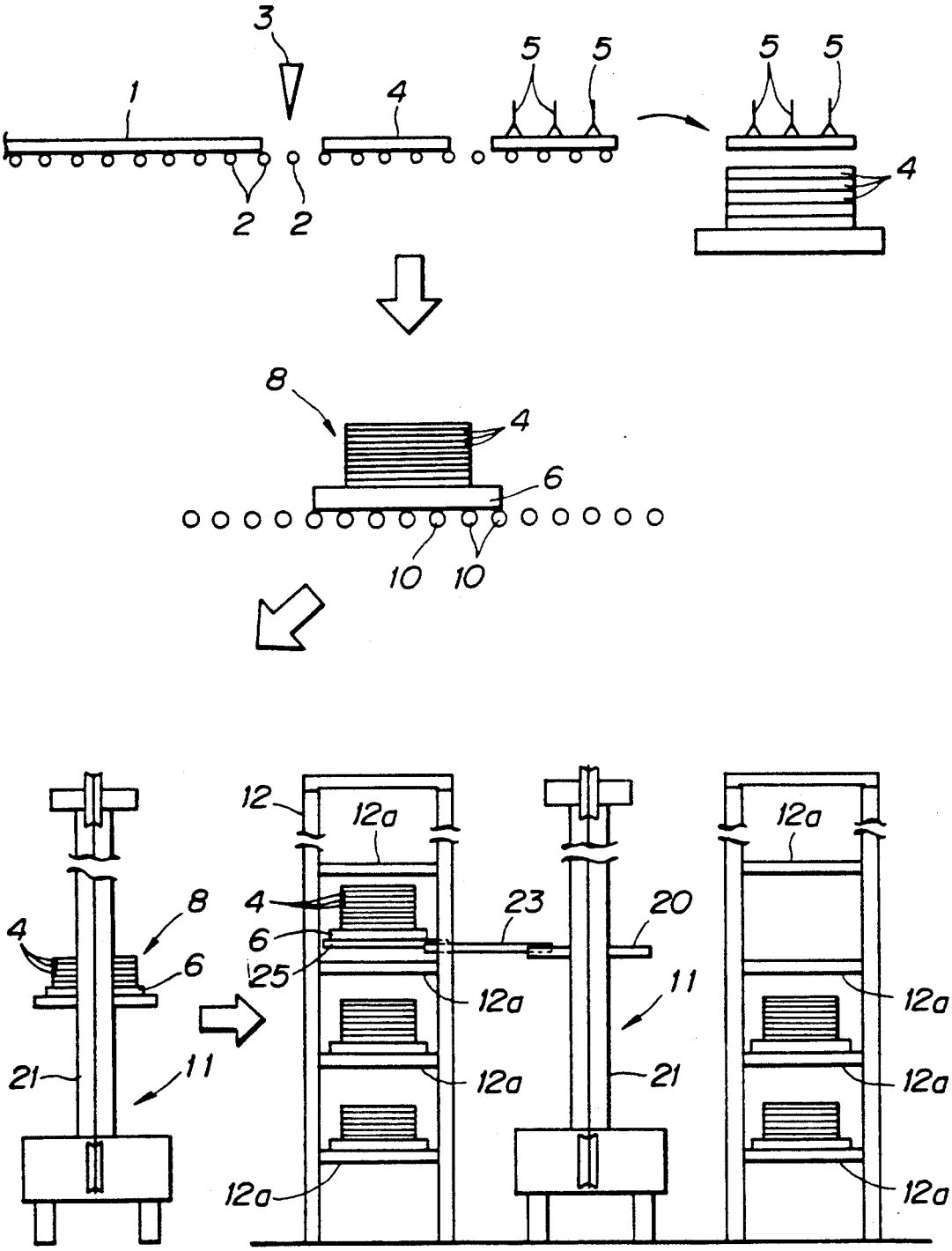
FIG. 1 is a schematic view showing a method of transferring and storing glass sheets according to the present invention.

FIG. 1 shows a method of the present invention. In FIG. 1, a glass ribbon, a conveyor, a cutter, and glass sheets are denoted by identical reference numerals used in FIG. 15.

A glass ribbon 1 delivered by a conveyor 2 is cut off on the conveyor 2 by a cutter 3 into glass sheets 4 of prescribed size, which are fed to the terminal end of the conveyor 2.

A sheet stacker (not shown) located at the terminal end of the conveyor 2 has a plurality of suction disks 5 for holding the delivered glass sheets 4, one by one, carrying them from the conveyor 2, and stacking them successively on a tray 6.

Figure 2:
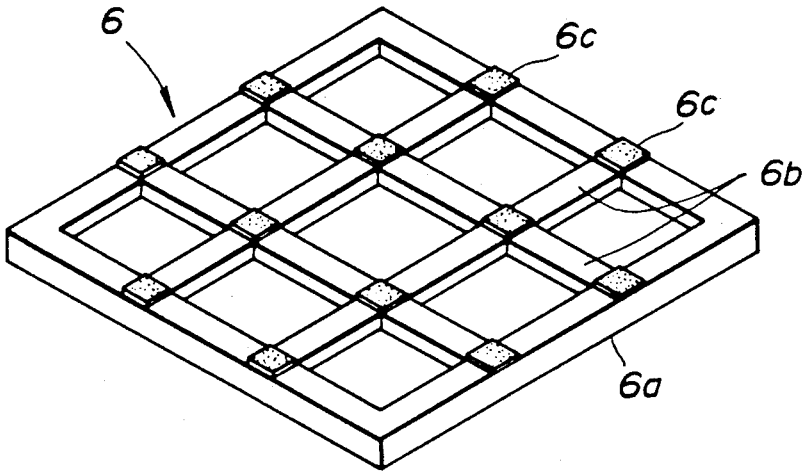
FIG. 2 is a perspective view of a tray.

As illustrated in FIG. 2, the tray 6 is of a grid-like structure comprising a substantially square outer frame 6*a* and crossing bars 6*b* extending between opposite frame members of the outer frame 6*a*. Dampers 6*c* of rubber or the like are attached to the upper surface of the tray 6 for preventing the glass sheet stack from slipping on the tray 6. The dampers 6*c* are disposed on the intersections of the crossing bars 6*b* and the intersections of the bars 6*b* and the frame members at spaced intervals. Therefore, the areas of the dampers 6*c* for contact with the glass sheet 4 are much smaller than the entire upper surface of the tray 6, for thereby reducing the risk of foreign matter getting in between the glass sheet 4 and the tray 6.

Figure 3B:
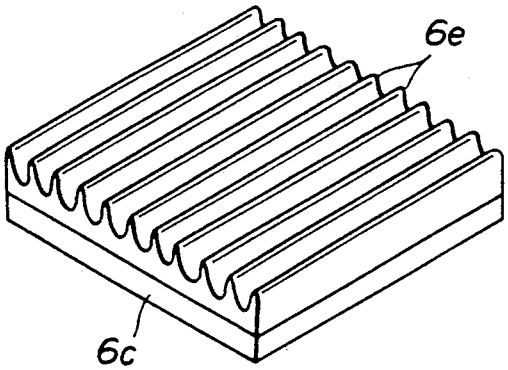
FIGS. 3A and 3B are enlarged perspective views of dampers.
Figure 3A:
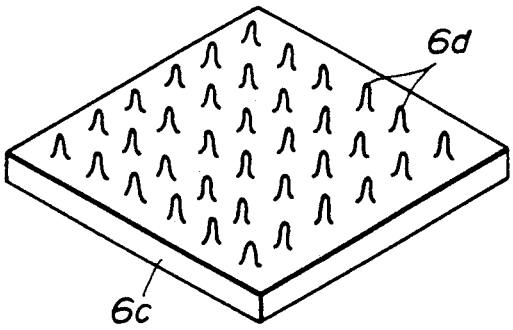

As shown in FIG. 3A, each of the dampers 6*c* has a number of projections 6*d* on its upper surface for preventing foreign matter from entering between the glass sheet 4 and the damper 6*c* and also for preventing the glass sheet 4 from slipping on the damper 6*c* effectively. As illustrated in FIG. 3B, a damper 6*c* may have parallel rib-like ridges 6*e* on its upper surface. Where dampers 6*c* shown in FIG. 3B are employed, the dampers 6*c* should be oriented on the tray 6 such that the ridges 6*e* on adjacent dampers 6*c* are directed perpendicularly to each other.

Alternatively, dampers 6*c* in the form of tapes may be applied to the tray 6 so as to extend longitudinally or laterally along the bars 6*b* and the frame members.

The tray 6 may be of a size which is large enough to support glass sheets 40 (FIG. 5) of maximum size intended to be handled. All trays 6 to be employed may be of such a size irrespective of different sizes of glass sheets 4, 40 to be carried thereon.

Figure 4:
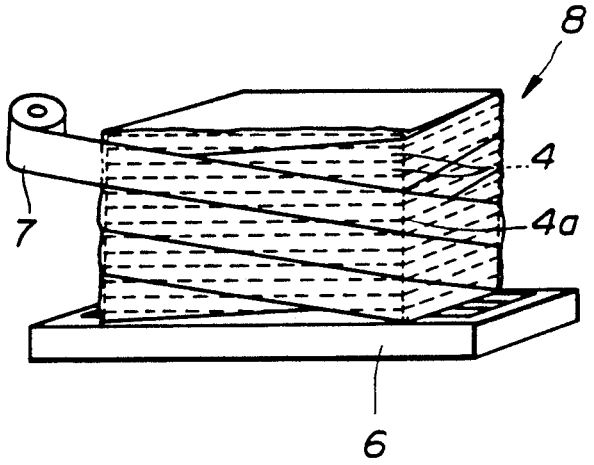
FIGS. 4 and 5 are perspective views showing the manners in which stacks of glass sheets of different dimensions placed on trays are packaged.
Figure 5:
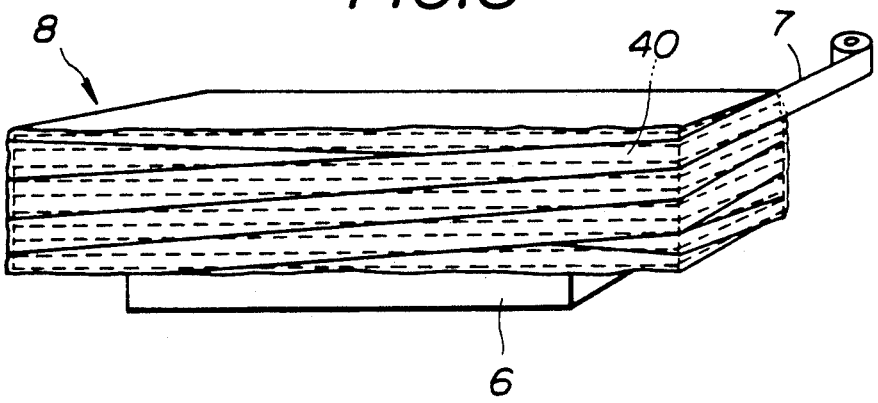

After a prescribed number of glass sheets 4 have been stacked on the tray 6, a film 7 such as a stretch film, a nylon film, or the like is wound around peripheral edges of the stacked glass sheets 4 by a packaging machine (not shown), thereby to form a packaged glass sheet stack 8 as shown in FIG. 4 or 5. The glass sheets 4 are therefore prevented from being displaced relatively to each other and hence from being scratched on acceleration or deceleration when they are transferred or on vibration such as earthquake-induced vibration during storage. Moreover, dust or other foreign matter is prevented from entering between the stacked glass sheets.

Figure 6:
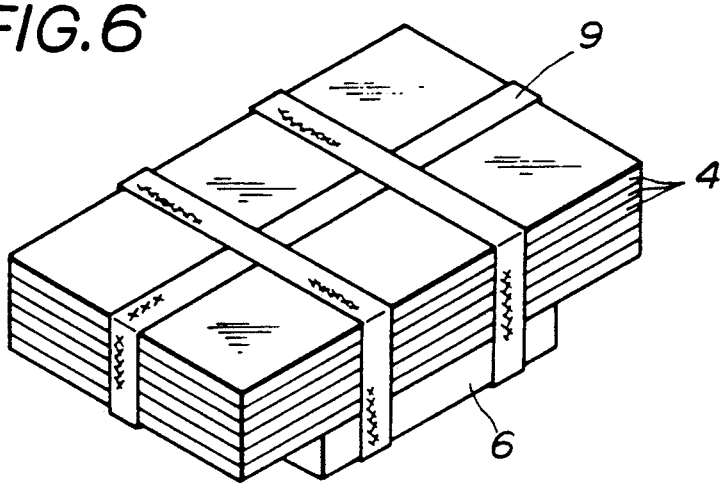
FIG. 6 is a perspective view of a differently packaged stack of glass sheets.

The tray 6 and the stacked glass sheets 4 thereon may be packaged together as shown in FIG. 6. More specifically, a band 9 of polypropylene is wound around the tray 6 and the glass sheet stack in crossing directions by directing the band 9 from an upper side of the glass sheet stack over edges of the tray 6 and the glass sheet stack, the back of the tray 6, and opposite edges of the tray 6 and the glass sheet stack onto the upper side of the glass sheet stack.

After the packaged glass sheet stack 8 has been formed, it is transferred by a roller conveyor 10 (FIG. 1) to a storage location such as a warehouse.

Then, the tray 6 and the packaged glass sheet stack 8 are hoisted by a crane 11 disposed at the terminal or downstream end of the roller conveyor 10, and then placed on one of vertically spaced storage racks 12*a* of a multiple-rack assembly 12 in the storage location.

Figure 7:
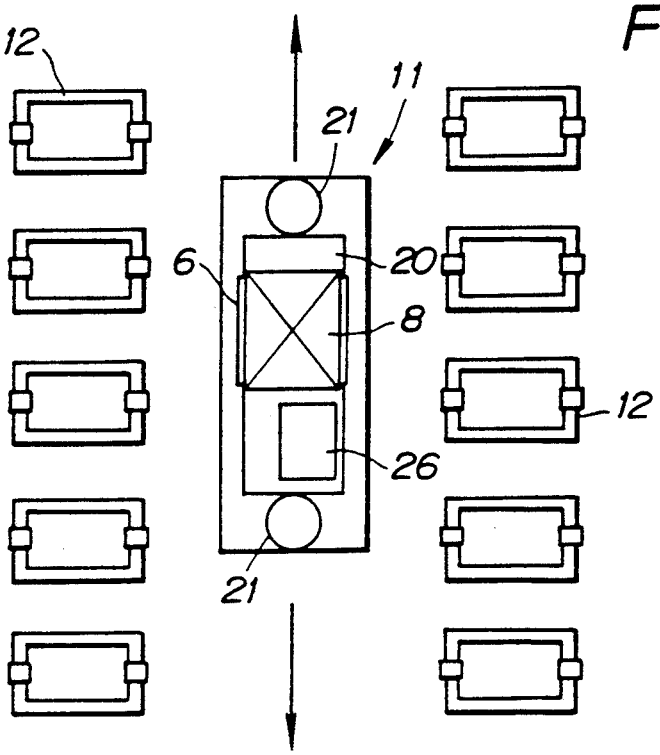
FIG. 7 is a plan view showing the positional relationship between glass sheet racks and a crane.
Figure 8:
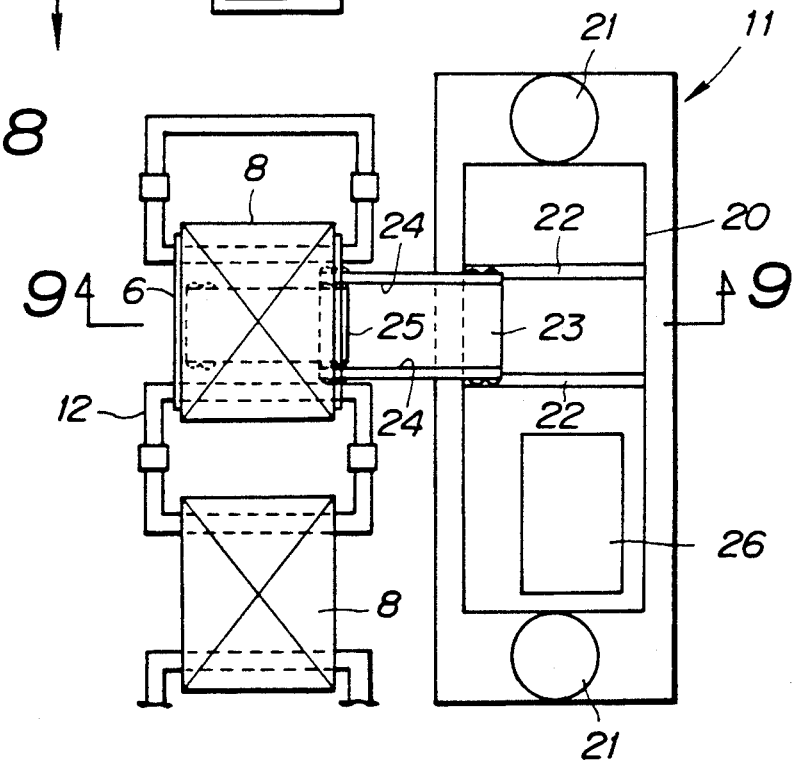
FIG. 8 is an enlarged plan view showing the manner in which glass sheets have been moved from a crane onto a rack.

As shown in FIG. 7, a plurality of rows of multiple-rack assemblies 12 are arranged in the storage location, and the crane 11 is movable linearly between two adjacent rows of multiple-rack assemblies 12. The crane 11 has a platform 20 for supporting a packaged glass sheet stack 8 thereon, the platform 20 being vertically movable along posts 21. As illustrated in FIG. 8, a pair of parallel spaced rails 22 is transversely mounted on the upper surface of the platform 20, the rails 22 having confronting grooves, respectively, A guide panel 23 has opposite side edges slidably supported in the respective grooves of the rails 22. The guide panel 23 is movable laterally beyond the opposite sides of the platform 20. The guide panel 23 has a pair of parallel spaced rails 24 mounted on respective opposite sides thereof and having confronting grooves, respectively. A support table 25 has opposite side edges slidably supported in the respective grooves of the rails 24, and is movable longitudinally beyond the opposite ends of the guide panel 23. The packaged glass sheet stack 8 is supported on the support table 25.

Figure 9:
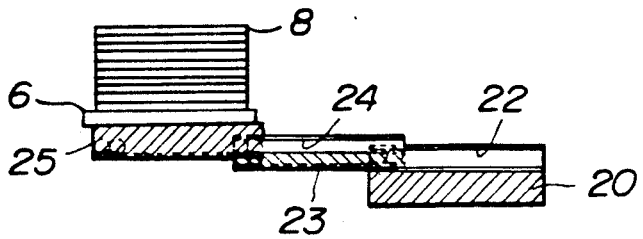
FIG. 9 is a cross-sectional view taken along line 9—9 of FIG. 8, illustrating a glass sheet support of the crane.

As shown in FIG. 9, the support table 25 has an upper surface 25*a* positioned at a level higher than the upper surface of the platform 20. Therefore, when the packaged glass sheet stack 8 is placed on the support table 25, the packaged glass sheet stack 8 will never touch the upper surface of the platform 20. When the guide panel 23 and the support table 25 are slidingly moved, they are prevented by suitable stops (not shown) from being dislodged from the platform 20 and the guide panel 23, respectively. On the platform 20, there is an operator control booth 26 for controlling vertical movement of the platform 20 and movement of the support table 25 between the platform 20 and a position between two closest storage racks 12*a*. It is also possible to control the platform 20 and the support table 25 fully automatically without operator's intervention.

Figure 10:
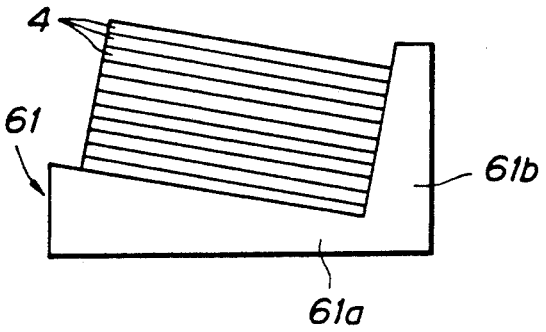
FIGS. 10 through 14 are elevational views of modified trays, respectively.
Figure 11:
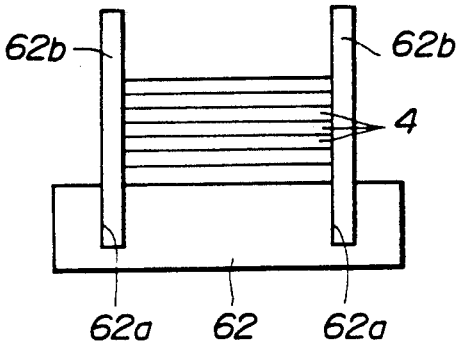
Figure 12:
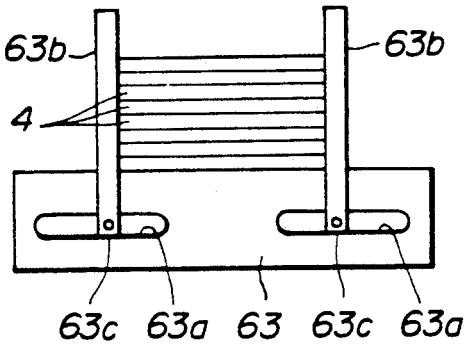
Figure 13:
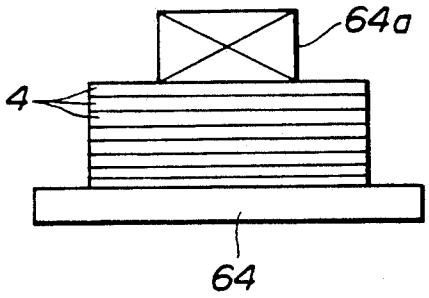
Figure 14:
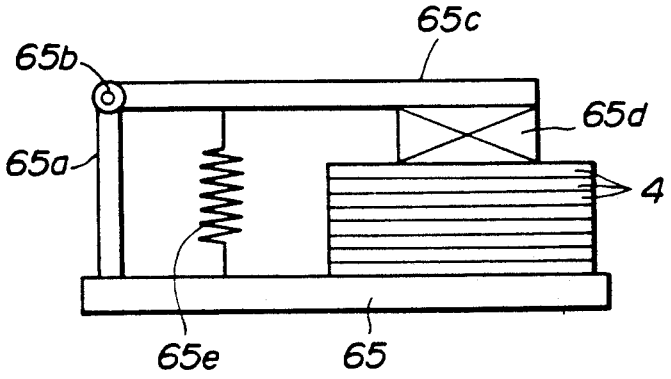

FIGS. 10 through 14 illustrate modified trays. A tray 61 shown in FIG. 10 is of an L shape composed of a base 61*a* and a side wall 61*b* mounted on one end of the base 61*a*. The base 61*a* has an upper surface slanted downwardly toward the side wall 61*b*, and the side wall 61*b* has an inner surface slanted outwardly in a direction away from the base 61*a* so that the inner surface of the side wall 61*b* extends substantially perpendicularly to the upper surface of the base 61*a*. In FIG. 11, a tray 62 has two recesses 62*a* defined in an upper surface thereof and spaced from each other, and glass sheet stack holders 62*b* are vertically mounted on the tray 62 with their lower ends inserted in the recesses 62*a*, respectively. FIG. 12 shows a still another modification in which a tray 63 has a pair of horizontal slots 63*a* defined in opposite sides thereof, and side plates or glass sheet stack holders 63*b* are adjustably fastened by bolts 63*c* to the tray 63 for movement along the slots 63*a*. In FIG.

13, a weight 64*a* is placed on a stack of glass sheets 4 placed on a tray 64, the weight 64*a* having on its lower surface a suitable means for preventing itself from slipping o the glass sheet stack. According to a still further modification shown in FIG. 14, a post 65*a* is vertically mounted on a tray 65, and a horizontal arm 65*c* is pivotally coupled by a shaft 65*b* to the upper end of the post 65*a*. A presser 65*d* is attached to the distal end of the arm 65*c*. A tension spring 65*e* is connected between the tray 65 and the arm 65*c* for normally urging the arm 65*c* downwardly to hold the presser 65*d* against a stack of glass sheets 4 for retaining them firmly between the presser 65*d* and the tray 65.

The conventional and inventive methods are compared for storage efficiency. It is assumed here that a glass sheet having a thickness of 2 mm and an area of 9.3 $m^2$ is referred to as one unit. When three or four pallets are stacked in a warehouse by the conventional method, 74 units are stored per 3.3 $m^2$. According to the inventive method, a warehouse having 10,010 racks and an occupied area of 1,708 $m^2$ is employed, for example. If 16 units are stored per rack, and the ratio of occupied racks to the total racks is 90%, then the total glass sheets that can be stored are 144,144 units, and the glass sheets per 3.3 $m^2$ are 278 units. Since 20 units can be stored on a single rack, the maximum glass sheets storable per 3.3 $m^2$ are 348 units. Therefore, the storage efficiency according to the present invention is 3.75 to 4.7 times the storage efficiency of the conventional method.

With the method of the present invention, since glass sheets are transferred as a stack, they can stably be transferred irrespective of the number of glass sheets transferred, and the number of stacked glass sheets can be varied as desired on a single tray.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

What is claimed is:

1. A method of transferring a plurality of flat glass sheets from a first location to a second location utilizing a tray having disposed on its upper surface at least one slippage inhibiting damper, comprising the steps of;

horizontally stacking the plurality of glass sheets one by one on the tray at the first location such that the lowermost surface of the lowermost glass sheet is held in contact with the slippage inhibiting damper for resisting displacement of said lowermost glass sheet relative to the damper;

helically wrapping packaging film around the sides of the horizontally stacked glass sheets without wrapping said tray so as to resist surface displacement of the stacked glass sheets relative to each other when transferred and to form a unitary package thereof; and transferring the unitary package together with said tray to the second location, said glass sheets being horizontally stacked on said tray during transfer.

2. A method of transferring from a loading location and storing at a storage location a plurality of glass sheets utilizing a tray having disposed on its upper surface at least one slippage inhibiting damper, comprising the steps of;

(a) horizontally stacking at the loading location, the glass sheets one by one on the tray, such that the lowermost surface of the lowermost glass sheet is held in contact with the slippage inhibiting damper for resisting displacement of said lowermost glass sheet relative to the damper, (b) helically wrapping solely around the sides of the horizontal stack of glass sheets and not around the tray a packaging film to resist displacement of the stacked glass sheets relative to each other without securing the stacked glass sheets to the tray;

(c) transferring the stack together with said tray to the storage location, said storage including a plurality of vertically spaced racks; and (d) placing the stack on one of the racks.

* * * * *

UNITED STATES PATENT AND TRADEMARK OFFICE

CERTIFICATE OF CORRECTION

PATENT NO. : 5,085,030

DATED : Feb. 4, 1992

INVENTOR(S) : Toyoo Segawa; Sinkichi Syono; Syuichi Suzue

It is certified that error appears in the above-identified patent and that said Letters Patent is hereby corrected as shown below:

In column 5, line 4, change "...o the glass" to --on the glass--.

In claim 2, column 6, line 40, "said storage including" should read --said storage location including--.

Signed and Sealed this

Twenty-seventh Day of April, 1993

*Attest:*

*Attesting Officer*

MICHAEL K. KIRK

*Acting Commissioner of Patents and Trademarks*